US005864921A

United States Patent [19]

Chou

[11] Patent Number: 5,864,921

[45] Date of Patent: Feb. 2, 1999

[54] EXTENSIBLE HANDLE ASSEMBLY

[76] Inventor: Cheng-Tsan Chou, 58, Ma Yuan West St., Taichung, Taiwan

[21] Appl. No.: 988,230

[22] Filed: Dec. 10, 1997

[51] Int. Cl.[6] ..... B25G 1/04

[52] U.S. Cl. ..... 16/115; 280/47.315; 280/655; 280/655.1

[58] Field of Search ..... 16/115; 190/115, 190/39; 280/655, 655.1, 37, 47.315

[56] References Cited

U.S. PATENT DOCUMENTS 5,630,250 5/1997 Chou ..... 16/115

*Primary Examiner*—Anthony Knight
*Assistant Examiner*—David Bochna

[57] ABSTRACT

An extensible handle assembly has a base seat, two outer pipes, two inner pipes, a press button, a grip, a cover plate, a positioning seat, two inner seats, two gears, two springs, two slide blocks, and two racks. Two sleeves are disposed in the positioning seat. Each sleeve receives the inner pipe. Each inner pipes is inserted in the outer pipe. Two link plate are disposed in the grip. The cover plate is disposed on the grip. A connection rod is inserted in the inner pipe. The connection rod has an upper end hooks the link plate. Each inner pipe has a lower through hole and a bottom slot. Each inner seat is inserted in the inner pipe to receive the gear, and the slide block. Each inner seat has a recess and a channel. Each gear has a center shaft inserted in the recess. Each slide block has a bottom notch engaging with the gear and an upper end hooked by a lower end of the connection rod. Each slide block receives a spring. Each rack is disposed between the inner pipe and the outer pipe.

1 Claim, 7 Drawing Sheets

EXTENSIBLE HANDLE ASSEMBLY

BACKGROUND OF THE INVENTION

The present invention relates to an extensible handle assembly. More particularly, the present invention relates to an extensible handle assembly for a suitcase.

A conventional handle device of a suitcase can be extended or retracted. However, the positioning device may not position the conventional handle device stably after the conventional handle device is extended or retracted. After a long period of usage, the positioning device may be worn out. Furthermore, the springs of the positioning device may lose its elasticity to decrease the function of the positioning device.

SUMMARY OF THE INVENTION

An object of the present invention is to provide an extensible handle assembly which can be positioned in a suitcase stably.

Accordingly, an extensible handle assembly comprises a base seat, two outer pipes, two inner pipes, a press button, a grip, a cover plate, a positioning seat, two inner seats, two gears, two springs, two slide blocks, and two racks. Two sleeves are disposed in the positioning seat. Each of the sleeves receives the respective inner pipe. Each of the outer pipes has an upper end disposed in the positioning seat and a lower end disposed in the base seat. Each of the inner pipes is inserted in the respective outer pipe. A first link plate and a second link plate are disposed in the grip. The cover plate is disposed on the grip. The first link plate has a first middle bar and a terminal pivot rod. The second link plate has a second middle bar and a terminal aperture. The grip has two sockets receiving the first middle bar and the second middle bar. The terminal pivot rod is inserted in the terminal aperture. A first connection rod has an upper end hooking the first link plate. The first connection rod is inserted in the respective inner pipe. A second connection rod has an upper end hooking the second link plate. The second connection rod is inserted in the respective inner pipe. Each of the inner pipes has a lower through hole and a bottom slot. Each of the inner seats is inserted in the respective inner pipe to receive the respective gear, and the respective slide block. Each of the inner seats has a recess and a channel. Each of the gears has a center shaft inserted in the respective recess. Each of the slide blocks has a bottom notch engaging with the respective gear and an upper end hooked by a lower end of the respective connection rod. Each of the slide blocks receives a spring. Each of the racks is disposed between the respective inner pipe and the respective outer pipe.

DETAILED DESCRIPTION OF THE INVENTION

Figure 1:
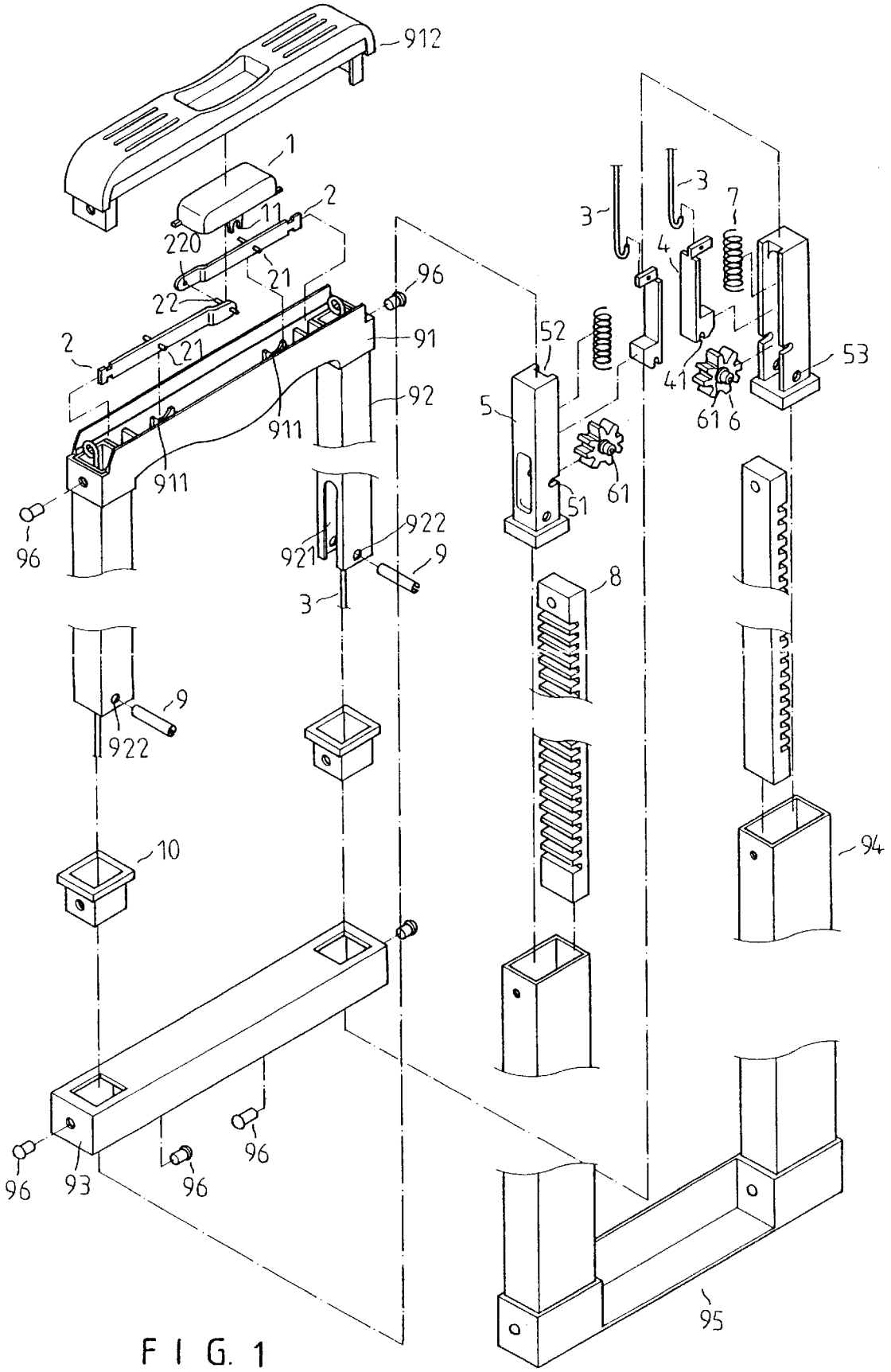
FIG. 1 is a perspective exploded view of an extensible handle assembly of a first preferred embodiment in accordance with the present invention.
Figure 2:
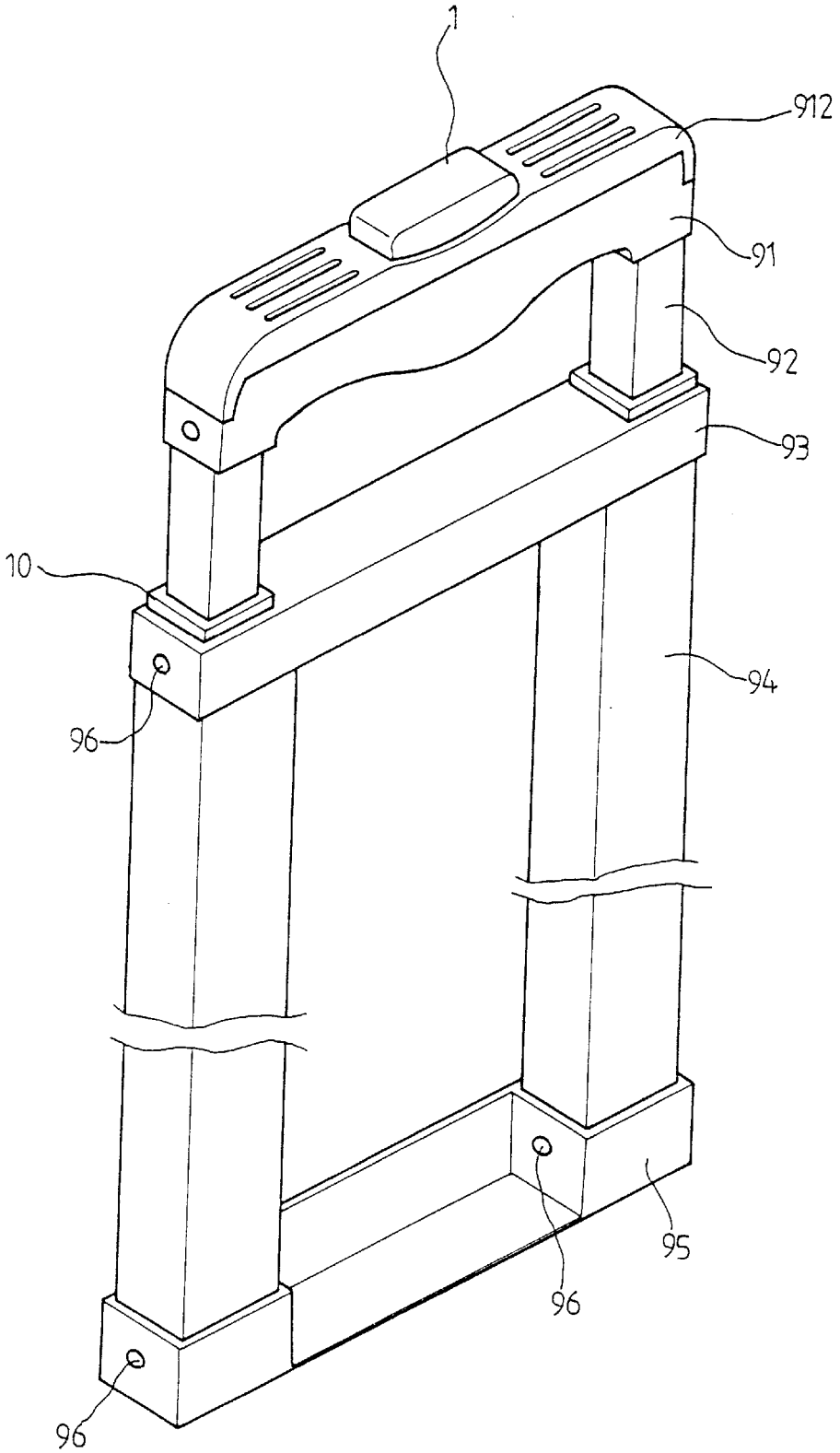
FIG. 2 is a perspective assembly view of an extensible handle assembly of a first preferred embodiment in accordance,with the present invention.
Figure 3:
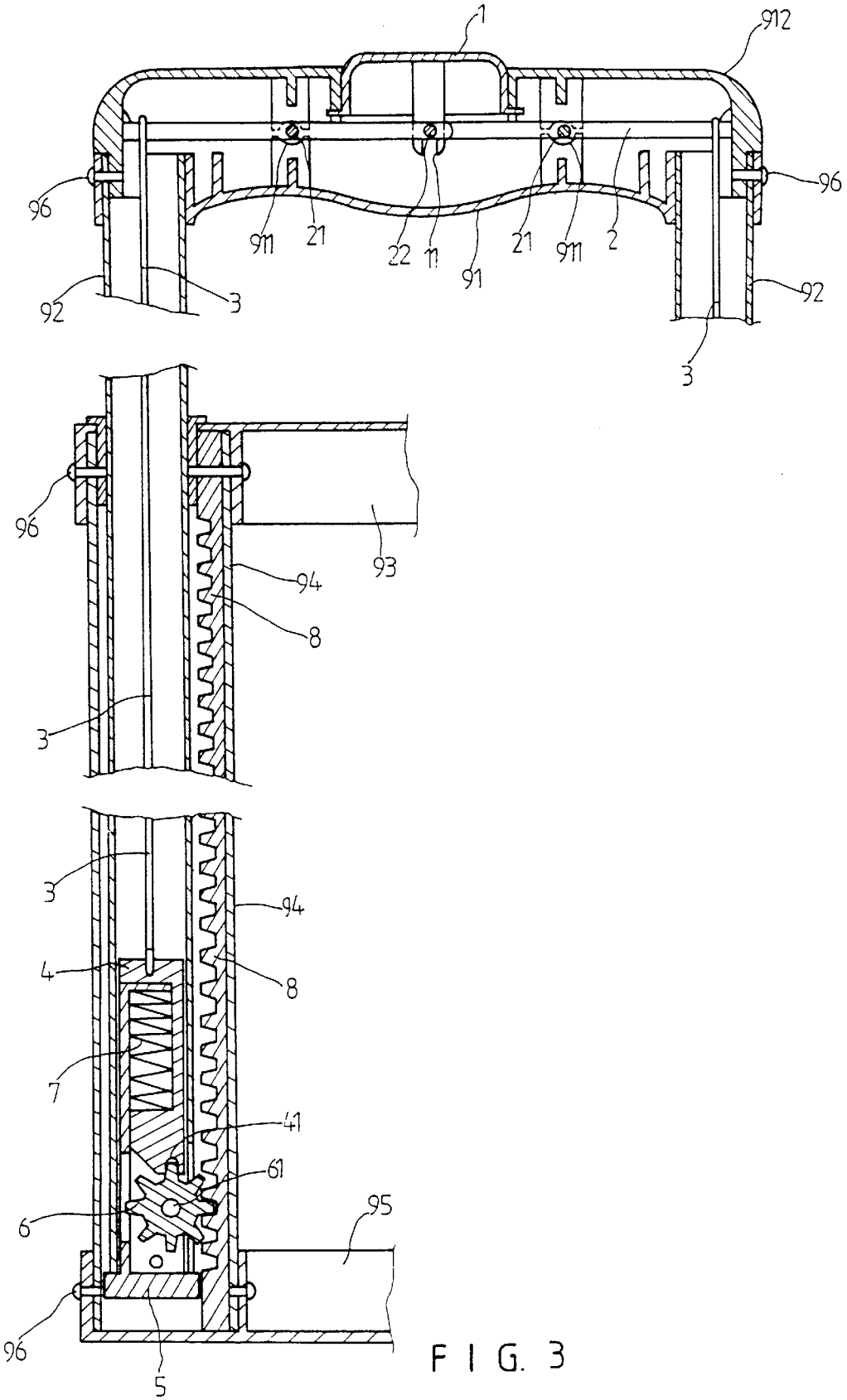
FIG. 3 is a partially sectional view of an extensible handle assembly of a first preferred embodiment in accordance with the present invention.
Figure 3A:
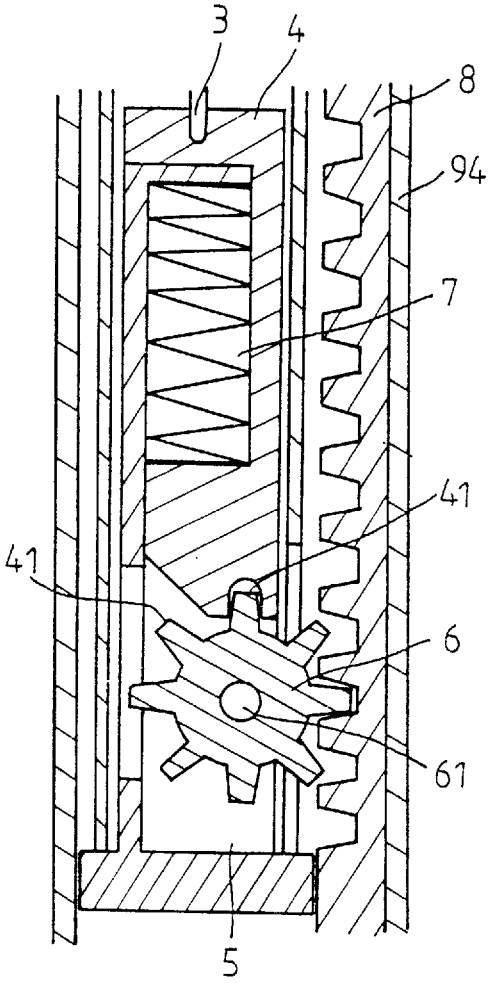
FIG. 3A is a partially enlarged view of FIG. 3.

Referring to FIGS. 1 to 3A, an extensible handle assembly comprises a base seat 95, two outer pipes 94, two inner pipes 92, a press button 1, a grip 91, a cover plate 912, a positioning seat 93, two inner seats 5, two gears 6, two springs 7, two slide blocks 4, and two racks 8. Two sleeves 10 are disposed in the positioning seat 93. Each of the sleeves 10 receives the respective inner pipe 92. Each of the outer pipes 94 has an upper end disposed in the positioning seat 93 and a lower end disposed in the base seat 95. Each of the inner pipes 92 is inserted in the respective outer pipe 94. A first link plate 2 and a second link plate 2 are disposed in the grip 91. The cover plate 912 is disposed on the grip 91. The first link plate 2 has a first middle bar 21 and a terminal pivot rod 22. The second link plate 2 has a second middle bar 21 and a terminal aperture 220. The grip 91 has two sockets 911 receiving the first middle bar 21 and the second middle bar 21. The terminal pivot rod 22 is inserted in the terminal aperture 220. A first connection rod 3 has an upper end hooking the first link plate 2. The first connection rod 3 is inserted in the respective inner pipe 92. A second connection rod 3 has an upper end hooking the second link plate 2. The second connection rod 3 is inserted in the respective inner pipe 92. Each of the inner pipes 92 has a lower through hole 922 and a bottom slot 921. Each of the inner seats 5 is inserted in the respective inner pipe 92 to receive the respective gear 6, and the respective slide block 4. Each of the inner seats 5 has a recess 51 and a channel 52. Each of the gears 6 has a center shaft 61 inserted in the respective recess 51. Each of the slide blocks 4 has a bottom notch 41 engaging with the respective gear 6 and an upper end hooked by a lower end of the respective connection rod 3. Each of the slide blocks 4 receives a spring 7. Each of the racks 8 is disposed between the respective inner pipe 92 and the respective outer pipe 94. Two rivets 96 fasten the sleeves 10 in the positioning seat 93. Two additional rivets 96 fasten the cover plate 912 and the grip 91. Each lower through hole 922 receives a pin 9. The press button 1 is disposed in the cover plate 912. A notch 11 is formed on a bottom of the press button 1.

Figure 4:
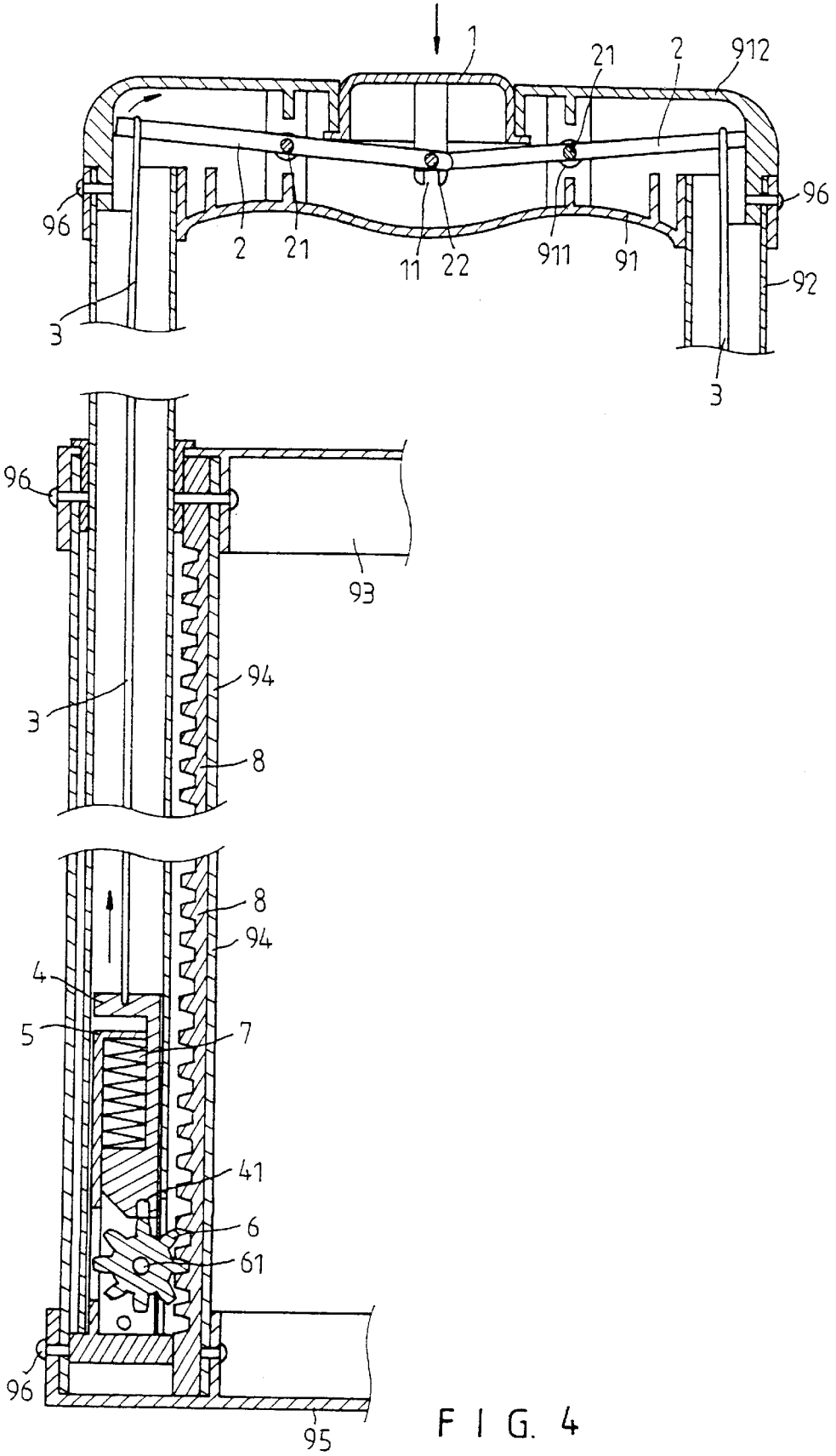
FIG. 4. is a sectional schematic view illustrating an operation of an extensible handle assembly of a first preferred embodiment.
Figure 4A:
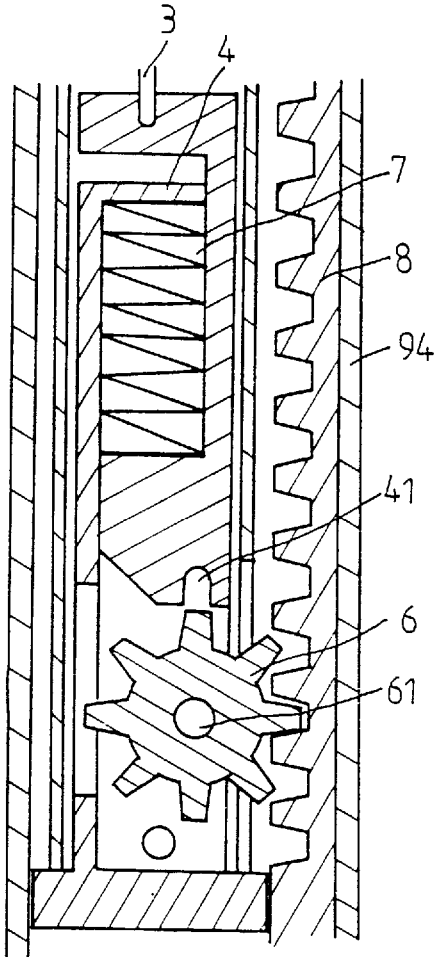
FIG. 4A is a partially enlarged view of FIG. 4.

Referring to FIGS. 4 and 4A, the press button 1 is pressed downward. The connection rods 3 move upward. The bottom notch 41 disengages from the respective gear 6. The gear 6 engages with the rack 8.

Figure 5:
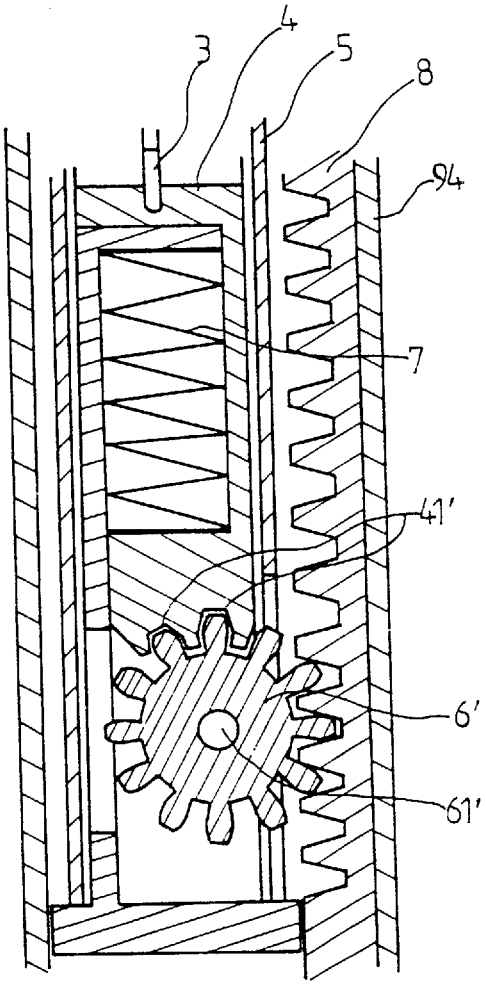
FIG. 5 is a partially enlarged view of a second preferred embodiment in accordance with the present invention.

Referring to FIG. 5, two bottom notches 41' replaces a single bottom notch 41. A pinion 6' having a shaft 61' replaces the gear 6.

The invention is not limited to the above embodiments but various modification thereof may be made. Further, various changes in form and detail may be made without departing from the scope of the invention.

I claim:

1. An extensible handle assembly comprises:

a base seat, two outer pipes, two inner pipes, a press button, a grip, a cover plate, a positioning seat, two inner seats, two gears, two springs, two slide blocks, and two racks, two sleeves disposed in the positioning seat, each of the sleeves receiving the respective inner pipe, each of the outer pipes having an upper end disposed in the positioning seat and a lower end disposed in the base seat, each of the inner pipes inserted in the respective outer pipe, a first link plate and a second link plate disposed in the grip, the cover plate disposed on the grip, the first link plate having a first middle bar and a terminal pivot rod, the second link plate having a second middle bar and a terminal aperture, the grip having two sockets receiving the first middle bar and the second middle bar, the terminal pivot rod inserted in the terminal aperture, a first connection rod having an upper end hooking the first link plate, the first connection rod inserted in the respective inner pipe, a second connection rod having an upper end hooking the second link plate, the second connection rod inserted in the respective inner pipe, each of the inner pipes having a lower through hole and a bottom slot, each of the inner seats inserted in the respective inner pipe to receive the respective gear, and the respective slide block, each of the inner seats having a recess and a channel, each of the gears having a center shaft inserted in the respective recess, each of the slide blocks having a bottom notch engaging with the respective gear and an upper end hooked by a lower end of the respective connection rod, each of the slide blocks receiving a spring, each of the racks disposed between the respective inner pipe and the respective outer pipe, and the press button disposed in the cover plate.

* * * * *